US006780035B2

(12) United States Patent
Bohbot

(10) Patent No.: US 6,780,035 B2
(45) Date of Patent: Aug. 24, 2004

(54) ELECTROSTATIC DISCHARGE PROTECTED JACK

(75) Inventor: Michel Bohbot, Cote Saint-Luc (CA)

(73) Assignee: Nordx/CDT, Inc. (CA)

( * ) Notice: Subject to any disclaimer, the term of this patent is extended or adjusted under 35 U.S.C. 154(b) by 50 days.

(21) Appl. No.: 10/097,535

(22) Filed: Mar. 12, 2002

(65) Prior Publication Data

US 2002/0151201 A1 Oct. 17, 2002

Related U.S. Application Data

(60) Provisional application No. 60/275,045, filed on Mar. 12, 2001.

(51) Int. Cl.[7] ..... H01R 29/00

(52) U.S. Cl. ..... 439/188; 439/108

(58) Field of Search ..... 439/188, 108, 439/181, 676; 200/51.1

(56) References Cited

U.S. PATENT DOCUMENTS 4,457,575 A * 7/1984 Davis et al. ..... 439/610
4,767,355 A * 8/1988 Phillipson et al. ..... 439/425
5,030,123 A 7/1991 Silver ..... 439/188
5,087,210 A * 2/1992 Myers et al. ..... 439/425
5,387,135 A * 2/1995 Shen et al. ..... 439/676
5,947,773 A 9/1999 Karam ..... 439/676
6,350,156 B1 * 2/2002 Hasircoglu et al. ..... 439/676
6,468,097 B1 * 10/2002 Bernstein et al. ..... 439/181

FOREIGN PATENT DOCUMENTS

EP 0 845 838 A2 6/1998
GB 2 352 339 A 1/2001

* cited by examiner

*Primary Examiner*—Tulsidas C. Patel
(74) *Attorney, Agent, or Firm*—Lowrie, Lando & Anastasi, LLP

(57) ABSTRACT

A method and apparatus for discharging accumulated static charge in unshielded twisted pair cables. According to one example, an electrical jack includes a housing having an opening defined therein through which a mating plug is received, a grounding strip, and at least one elastically deformable signal contact residing within the housing. As the mating plug is received, the elastically deformable signal contact may move from a position in contact with the grounding strip to a position not in contact with the grounding strip, thereby discharging static charge from the unshielded twisted pair cables and allowing normal connection to the mating plug.

19 Claims, 7 Drawing Sheets

ELECTROSTATIC DISCHARGE PROTECTED JACK

CROSS-REFERENCE TO RELATED APPLICATIONS

This application claims priority under 35 U.S.C. §119(e) to commonly owned, copending U.S. provisional patent application Serial No. 60/275,045 entitled "Electrostatic Discharge Protected Jack", filed Mar. 12, 2001 (not published), which is herein incorporated by reference in its entirety.

BACKGROUND

1. Field of the Invention

The present invention relates to cabling systems, and more particularly to connectors that may be used in systems including elements sensitive to static electric discharges.

2. Discussion of Related Art

Unshielded twisted pair (UTP) cables include several, for example, four, twisted pairs of conductors surrounded by a dielectric insulation. These cables are often used in high speed networks, for example, a local area network (LAN), to connect equipment, such as computers and/or telephones.

Unshielded twisted pair cables that are left unconnected or temporarily unused in a cabling system tend to act as capacitors and accumulate charge. The cables can often build up a very high charge, for example, up to 15 kV, which can cause serious damage to network equipment if the cable is connected before the accumulated charge is dissipated.

The cables can accumulate charge in a number of different ways. For example, if a cable is dragged along the floor, positive charges are created at the surface of the cable. The positive charges on the surface tend to attract negative charges on the twisted pairs, which causes charge separation leading to positive charges being present at the ends of the cable. If the cable is plugged into a directly or capacitively grounded connector, this build up of charge may cause arcing which could damage the cable or equipment to which the cable is connected. In another example, a cable that is placed in a strong electrostatic field and left there for some time will also accumulate charge on its surface. This charge tends to polarize the twisted pairs and cause some migration of the charge inside the dielectric insulation of the cable. After the cable is removed from the external electrostatic field, the charge remains, inducing a positive charge at the ends of the cable, as described above. Unconnected cables that are left in a dry environment can also accumulate charge from dust or other particles settling on the cable insulation.

When a cable has accumulated a large charge between its twisted pairs and the surroundings, this differential charge will cause charge carriers to migrate into the dielectric insulation. If the twisted pairs are grounded for a few seconds, the charge on the twisted pairs themselves, which can move quickly through the copper, will be neutralized. However, the charge carriers inside the dielectric insulation will not be removed. Thus, after removing the ground connection, the charges in the insulation will again cause a charge separation on the twisted pairs, leading to a potential difference between ground and the end of the twisted pairs. This potential difference may still damage network equipment when the cable is connected. For this an other reasons, providing shielded connector jacks in the cabling system will not effectively discharge the cables. Shielded jacks and electronic components on networking equipment are designed to dissipate charge build-ups according to the "Human body model," i.e., the cable has accumulated an amount of static charge similar to that accumulated by a person, and having a similar characteristic. The static charge accumulated by unconnected UTP cables is often far greater than the "Human body model" and has a different discharge characteristic, and thus shielded jacks and electronic components on networking equipment are not an effective solution.

SUMMARY OF THE INVENTION

According to one embodiment, an electrical jack may include a housing having an opening defined therein through which a mating plug is received, a grounding strip and at least one elastically deformable signal contact residing within the housing. As the mating plug is received, the elastically deformable signal contact may move from a position in contact with the grounding strip to a position not in contact with the grounding strip, thereby grounding any electrostatic charges present in the mating plug.

According to another embodiment, an electrical connector panel comprises a housing and a plurality of connector jacks disposed in the housing. Each jack includes a plurality of spring contacts and the plurality of jacks is adapted to mate with a corresponding plurality of connector plugs. The connector panel further includes a grounding strip, coupled to a housing ground terminal, at least a portion of the grounding strip being disposed in a rear of the panel such that the plurality of spring contacts of each of the plurality of connector jacks are in contact with the grounding strip when in a first position, and wherein the plurality of spring contacts of one of the plurality of connector jacks move to a second position, not in contact with the grounding strip, when a connector plug is received by the connector jack.

According to one example, the grounding strip of either of the above embodiments may comprise metal or conductive plastic, or may include a dielectric with electrical circuitry disposed thereon.

Another embodiment includes a cabling system comprising at least one electrical cable terminated in a connector plug and a connector panel including at least one electrical jack adapted to receive and mate with the connector plug of the electrical cable, the electrical jack including a plurality of spring contacts movable between a first position and a second position. A grounding strip is disposed in the connector panel such that the plurality of spring contacts of the electrical jack are in contact with the grounding strip when in the first position, and the grounding strip is coupled to a chassis ground terminal. The cabling system further comprises network equipment coupled to the connector panel, and terminal equipment coupled to the connector panel by the at least one electrical cable. The plurality of spring contacts of the electrical jack are moved into the second position when the connector plug is received by the electrical jack, and the plurality of spring contacts are not in contact with the grounding strip when in the second position.

According to yet another embodiment, a method of discharging an unshielded twisted pair cable includes steps of securing a grounding strip in a housing of an electrical jack having a plurality of movable signal contacts and an opening adapted to receive a mating connector plug, such that the movable signal contacts are in contact with the grounding strip when in a first position, inserting the mating connector plug that terminates the unshielded twisted pair cable into the opening, and causing, by said inserting, the movable signal contacts to elastically deform to a second position not in contact with the grounding strip, thereby grounding any electrostatic charges present in the mating connector plug.

BRIEF DESCRIPTION OF THE DRAWINGS

The foregoing, and other features and advantages of the device will be apparent from the following non-limiting description of various exemplary embodiments, and from the accompanying drawings, in which like reference characters refer to like elements throughout the different figures. It is to be appreciated that the drawings are for the purpose of illustration only and are not intended as a definition of the limits of the invention. In the drawings.

DETAILED DESCRIPTION

Figure 1:
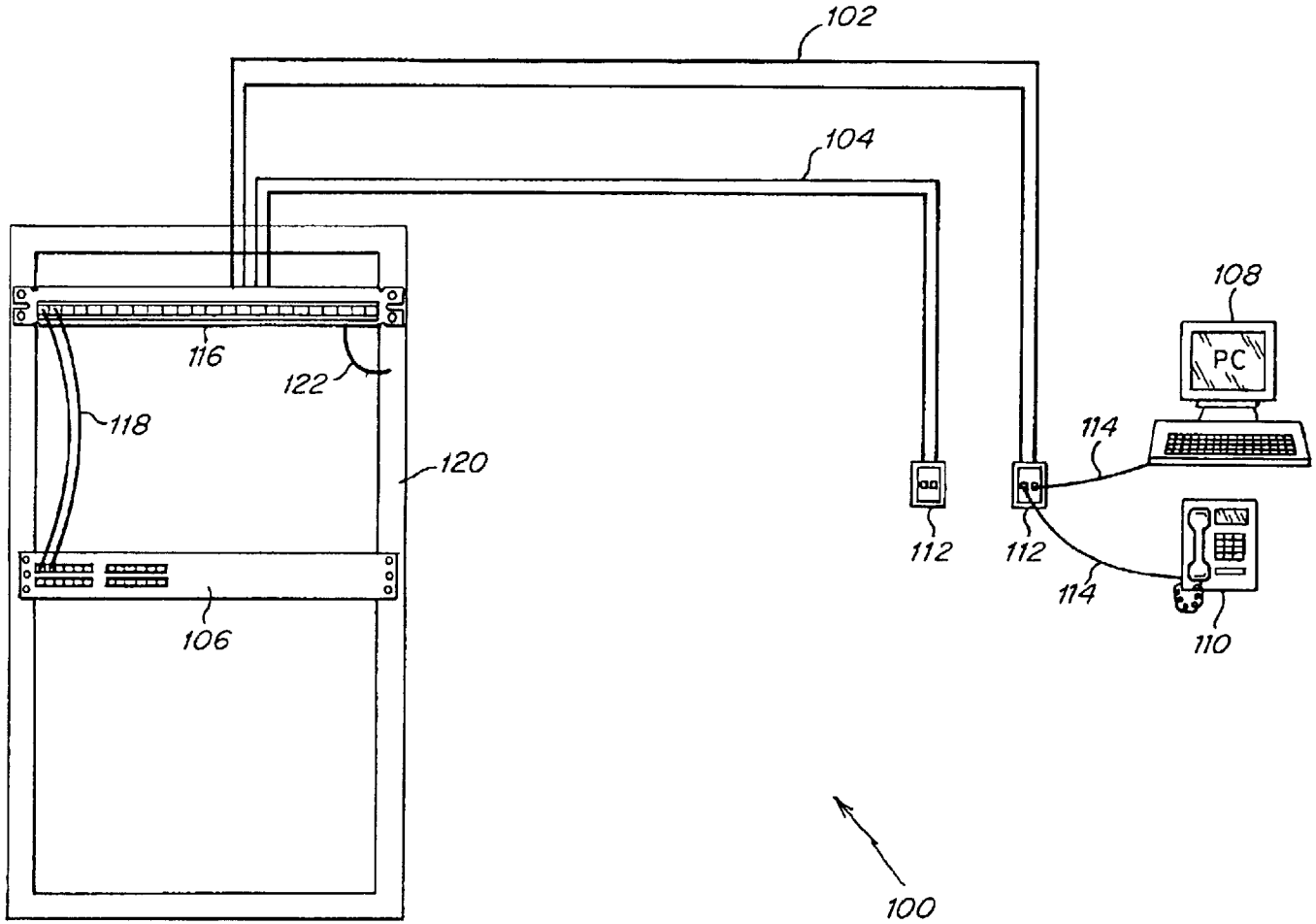
FIG. 1 is a schematic block diagram of an exemplary cabling network in which the connector jack of the present invention may be used.

Referring to FIG. 1, there is illustrated an exemplary cabling system 100 including a plurality of unshielded twisted pair (UTP) cables 102, 104 and network equipment, such as hub equipment 106 and terminal devices, for example a computer 108 or telephone 110. The exemplary cabling system 100 includes outlets 112 to which the terminal devices are connected by means of patch cables 114. The UTP cables 102, 104 connect the outlets 112 to a connector panel 116, which, is in turn connected to the hub equipment 106 via patch cables 118. Of course, it is to be appreciated that other configurations of cabling system may equally embody the present invention.

In the illustrated example, UTP cables 104 are connected to an unused outlet 112 (i.e., no terminal devices are attached to the outlet) and may thus accumulate charge as described above. In order to prevent the accumulated charge from discharging into any terminal devices that may later be connected to cables 104 through the outlet 112, thereby damaging the terminal devices, the outlet 112 and/or connector panel 116 may be equipped with means for discharging the cable 104. This means may include means for continuously discharging the cable, thereby preventing an accumulative buildup of charge, or means for discharging any previously built up charge at the later time when a terminal device, or other network equipment, is attached, without damaging the network equipment. It should be noted that the illustrated embodiment of aspects of the invention will also be effective to protect against charges built up in a previously unused patch cable 114, 118 that is later placed into service. The means and its operation is described in more detail below.

Figure 2:
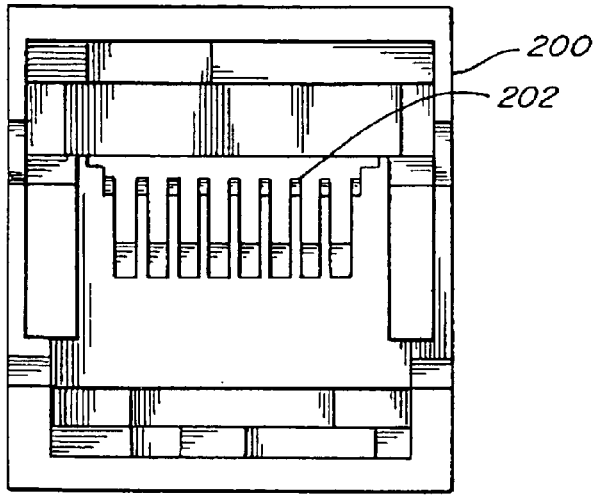
FIG. 2 is a rear view of a connector housing, showing dividers which separate one signal contact from another.

FIG. 2 illustrates an exemplary housing 200 of an RJ-45 style connector jack embodying aspects of the invention. It is to be appreciated that although the following description will refer to RJ-45 style connector jacks, the invention is not so limited, and may be adapted to be used in other types of connector jacks having elastically deformable signal contacts, or otherwise movable signal contacts. Referring to FIG. 2, it can be seen that the housing 200 includes a slotted separator 202 which may accommodate eight signal contacts. It is to be appreciated that although the illustrated example accommodates eight signal contacts, the invention is not so limited, and the housing may be adapted to accommodate any number of signal contacts as necessary.

Figure 3:
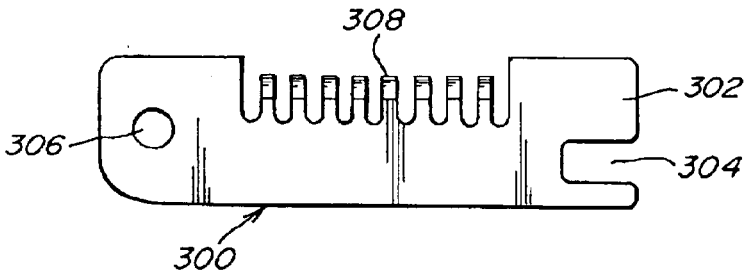
FIG. 3 is a plan view of an exemplary embodiment of a grounding strip suitable for use in the connector housing of FIG. 2.
Figure 4:
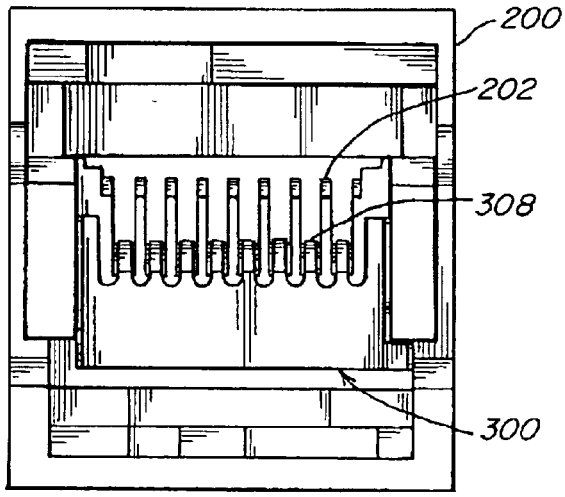
FIG. 4 is a rear view of the connector housing of the FIG. 2 with the grounding strip of FIG. 3 installed.

Referring to FIG. 3, there is illustrated, in plan view, an exemplary embodiment of a grounding strip 300 that may be used in combination with the housing of FIG. 2. The housing 200 may receive the grounding strip of FIG. 3 through holes in the sides of the housing 200, through which the grounding strip 300 is positioned as shown in FIG. 4. The grounding strip 300 may be provided with features, such as end portions 302 and indentation 304, adapted to maintain the grounding strip 300 within the housing 200. The grounding strip 300 may further be provided with a hole 306 through which a pin (not shown) of the housing 200 fits to secure the grounding strip 300 within the housing 200. As shown in FIG. 3, the grounding strip 300 may be also provided with contact portions 308 that fit between the slotted separator 202 of the housing 200 when the grounding strip 300 is inserted into the housing 200.

Figure 5:
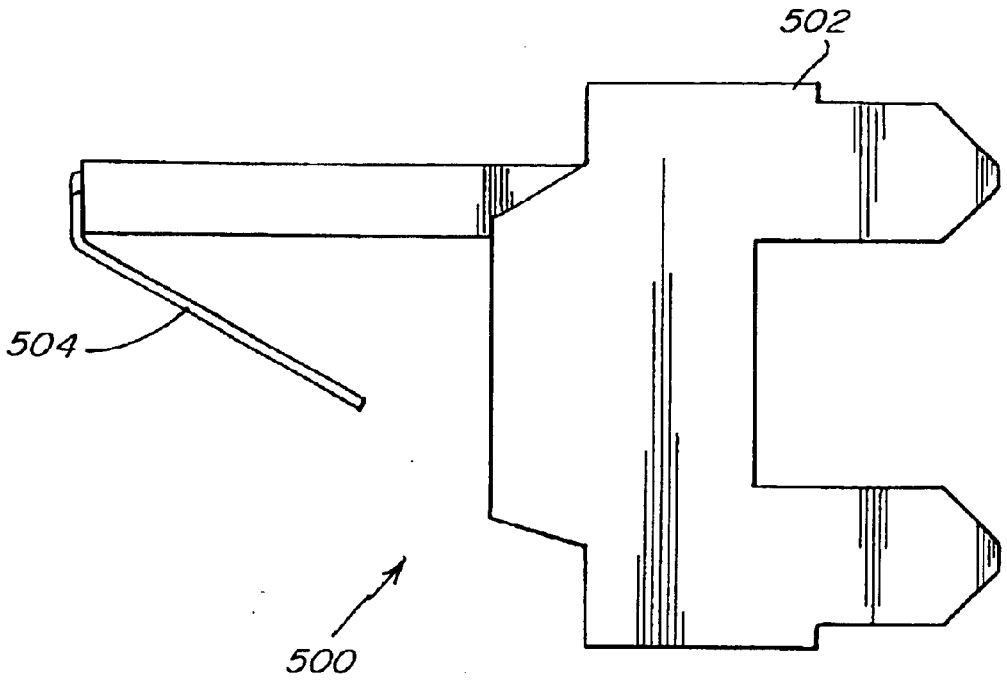
FIG. 5 is a side view of the spring contacts which reside in the connector housing of FIG. 1, when assembled.

Referring to FIG. 5, there is illustrated, in side view, an exemplary contact assembly portion 500 of a connector jack. The contact assembly 500 may be inserted into the back of the housing 200 of FIG. 4, such that the signal contacts 504 contact the contact portions 308 of the grounding strip 300. When a plug, for example, terminating a UTP cable, is inserted into the assembled connector, the plug signal contacts first make contact with the grounded jack signal contacts. Then, the plug signal contacts begin to elastically deform and flex the jack signal contacts away from the grounding strip. This will be described in more detail below in reference to FIGS. 8–10. Thus, any static charge carried by the cable attached to the plug signal contacts is discharged into the grounding strip before the jack signal contacts are disconnected therefrom. This serves to protect any electrical equipment connected to the jack. According to one example, if a patch cable 114 (see FIG. 1) has been left unconnected for some time and has accumulated static charge, when the patch cable 114 is connected into an outlet 112 that includes the connector jack embodying to aspects of the invention, the static charge accumulated within patch cable 114 will discharge into the grounding strip as the patch cable is connected, thereby preventing any damage from occurring to the terminal device. It is to be appreciated that the above-described connector jack may be used in many applications as a stand-alone unit or in combination with other connector jacks, for example, in the connector panel 116 or outlet 112 of FIG. 1.

Figure 6:
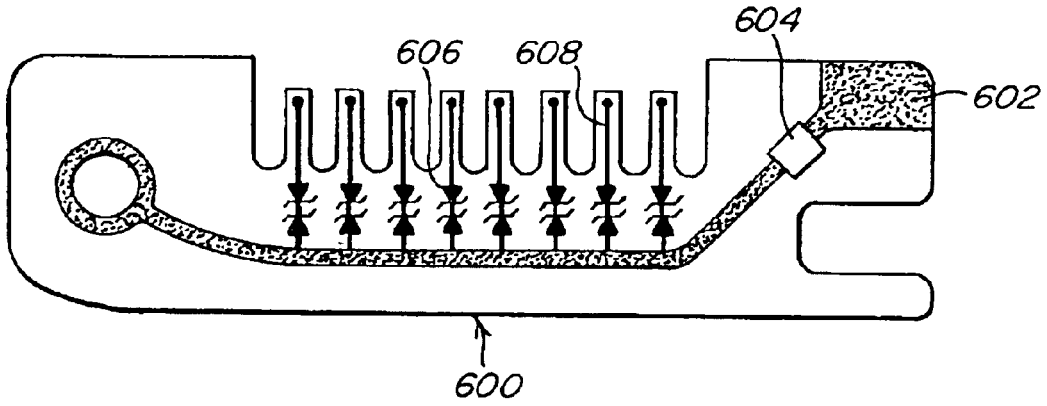
FIG. 6 is a plan view of another exemplary grounding strip that may be used in the connector housing of FIG. 2.

According to one example, the grounding strip (FIG. 3, 300) may be constructed of metal, or of a conductive plastic. In another example, the grounding strip (FIG. 6, 600) may include a dielectric material with electrical circuitry disposed thereon to provide a grounding connection 602 for the contacts of the connector jack, as shown in FIG. 6. It is to be appreciated that the electrical circuitry may include many variations, provided it performs the basic function of grounding the contacts of the connector jack. Furthermore, the grounding strip may be connected to a ground terminal, which may be a grounded portion of the connector housing, or a grounded portion of the outlet 112 (see FIG. 1) or connector panel 116 in which the connector jack is disposed. It is to be noted that this ground terminal may be a "chassis ground", which may not be equivalent to a "signal ground" of signals propagating in the cables and signal contacts 504 of the connector jack. In addition, the grounding strip 300 may not be directly connected to the ground terminal. For example, one or more resistors 604 may be connected in series between the grounding strip 300 and the ground terminal to provide a load through which an attached cable is grounded. The grounding strip 600 may further include contact portions 608 that contact the signal contacts of the connector jack. According to yet another example, the signal contacts may be provided with discharge protectors 606, for example, zener diodes, connected between the signal contacts 504 and the ground terminal 602 to provide additional protection against static discharges. These discharge protectors 606 may be included in the electrical circuitry disposed on the grounding strip 600, as shown, but may also be provided within the housing of the connector jack as separate elements from the grounding strip.

Figure 7:
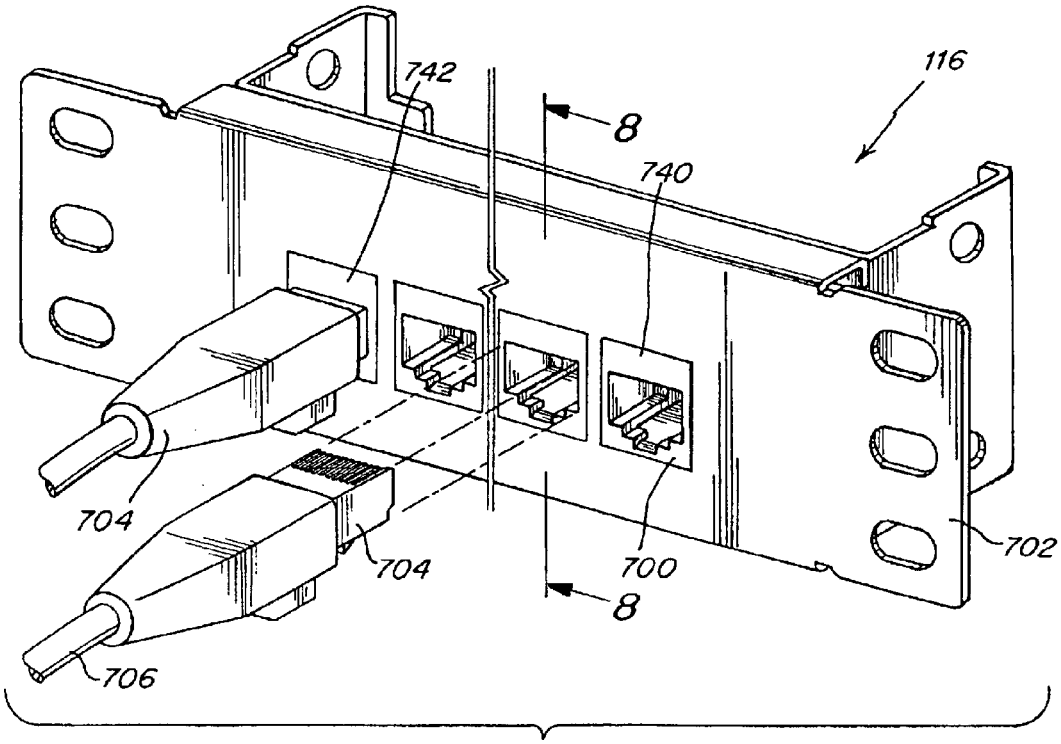
FIG. 7 is a perspective view of an exemplary embodiment of a connector panel according to aspects of the invention.

Referring to FIG. 7, there is illustrated an exemplary embodiment of a connector panel 116 that may be used in the cabling system 100 of FIG. 1. As illustrated, the connector panel 116 may include a plurality of connector jacks 700 mounted in a housing 702. It is to be appreciated that although the illustrated embodiment includes four connector jacks 700, the connector panel is not so limited, and may include any number of connector jacks as necessary. The connector jacks 600 of the connector panel 116 may be RJ-45 style connector jacks, as described above, or another type of connector jack having elastically deformable, or otherwise movable, signal contacts. As shown, the connector jacks 700 are adapted to receive and mate with a corresponding connector plug 704 attached to UTP cable 706. In one example, as shown in FIG. 1, the housing portion 702 may be mounted to an equipment rack or chassis 120 that may house a plurality of network equipment, such as hub equipment 106. Placement of the connector panel 116 in the equipment rack 120 may be advantageous as it may be convenient for connecting the network equipment to the connector panel 116 via patch cables 118.

Figure 8:
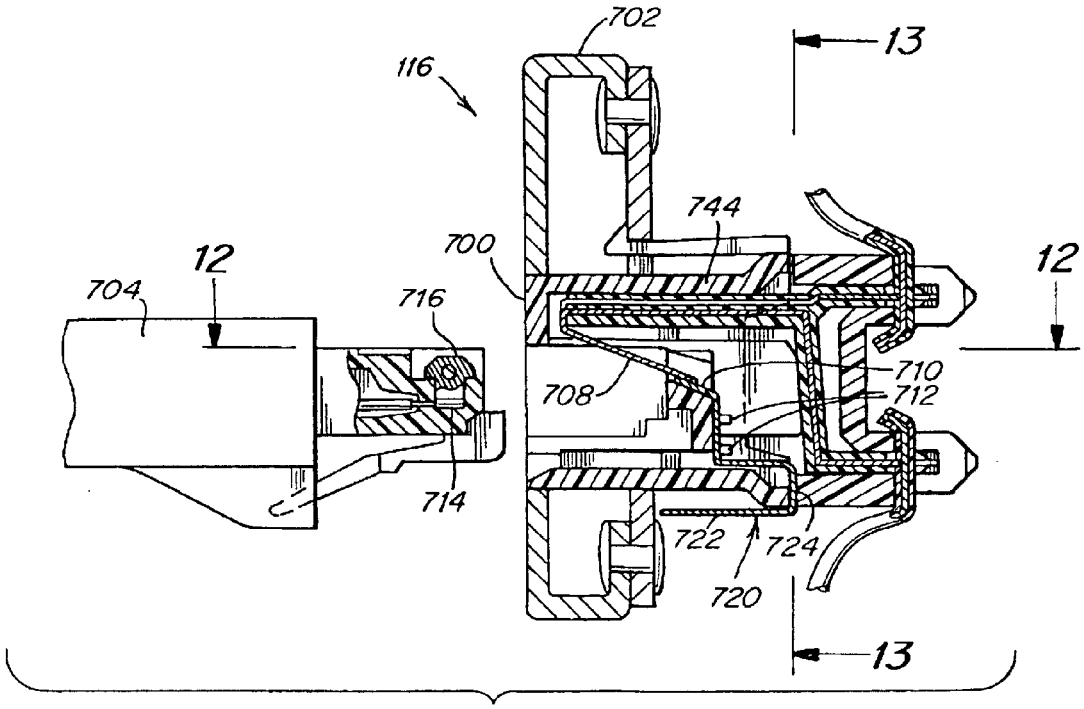
FIG. 8 is cross-sectional side view of the connector panel of FIG. 7 taken along lines 8—8 of FIG. 7.

Referring to FIG. 8, an exemplary connector jack 700 is shown in cross-section, with a corresponding connector plug 704 shown not yet mated with the connector jack 700. The connector jack 700 includes spring signal contacts 708 that are in contact with contact portions 710 of a grounding strip. Thus, before the connector plug 704 is mated with the connector jack 700, the signal contacts 708 of the connector jack 700 are continuously grounded, thereby preventing any build-up of static charge in a cable connected to the connector jack, for example cable 104 (see FIG. 1). The grounding strip may include tabs 712 that hold the contact portions 710 in place within the housing of the connector jack 700.

Figure 9A:
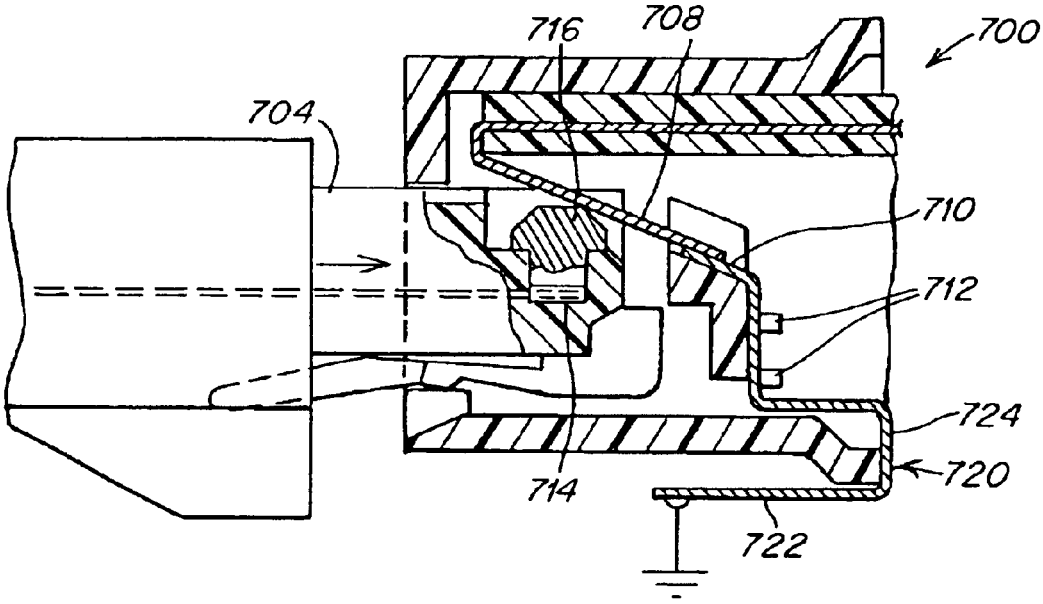
FIG. 9*a* is a cross-section of the connector panel of FIG. 7 with a connector plug partially inserted within the connector jack.
Figure 9B:
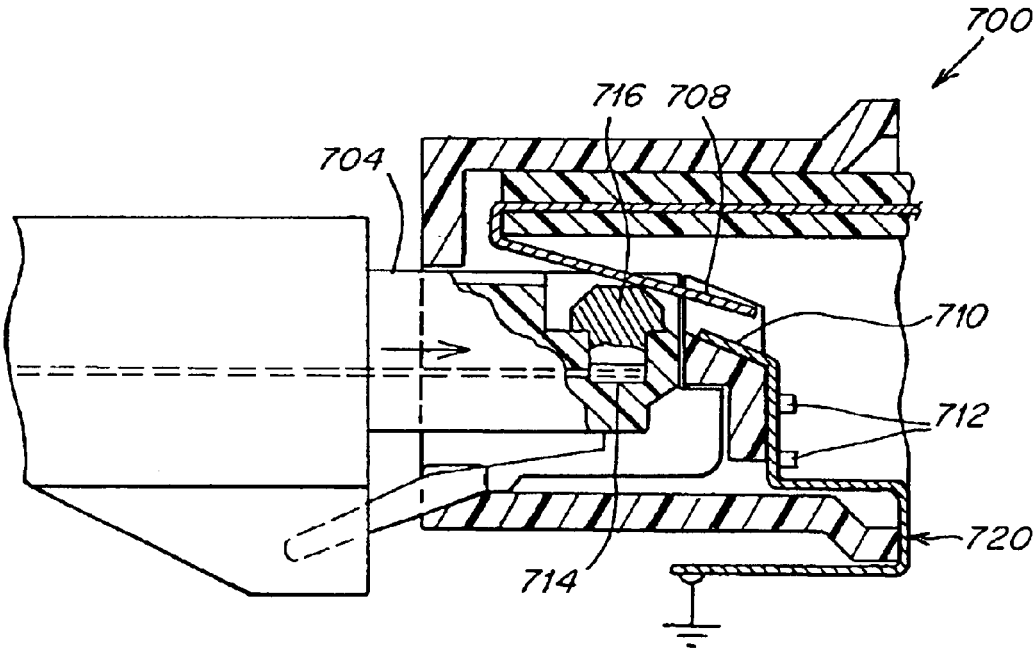
FIG. 9*b* is a cross-section of the connector panel of FIG. 7 with a connector plug fully inserted within the connector jack.

Referring to FIGS. 9*a* and 9*b*, it can be seen that when the connector plug 704 is partially inserted within the connector jack 700, as shown in FIG. 9*a*, the spring signal contacts 708 of the connector jack are still in contact with the contact portions 710 of the grounding strip 720. Thus, the portion 716 of the plug signal contacts 714 initially make contact with the grounded jack signal contacts 708. When the connector plug 704 is fully mated with the connector jack 700, as shown in FIG. 9*b*, the plug signal contacts 714 cause the jack signal contacts 708 to elastically deform and flex away from the grounding strip contact portions 710, as described previously. Thus, when the plug is fully mated with the connector jack 612, the jack signal contacts are no longer grounded. As shown in FIG. 1, the grounding strip 720 may be connected to a ground terminal, such as the equipment rack 120. This connection may be made via a grounding patch cable 122, as illustrated, or by another suitable means, for example, a screw or rivet (not shown) fastening the connector panel 116 to the equipment rack 120. It is to be appreciated that this "chassis ground" is not necessarily equal in voltage to a signal ground of the signals propagating in the various UTP cables and in the network equipment.

Figure 10:
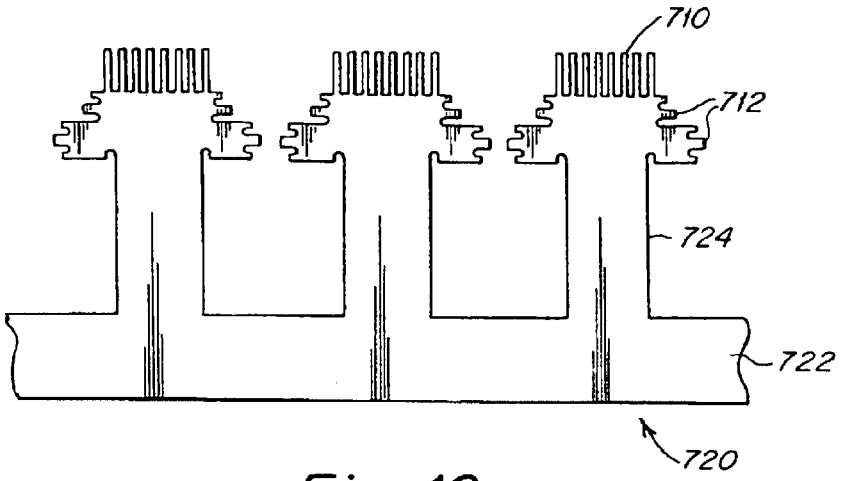
FIG. 10 is a plan view of an exemplary embodiment of a grounding strip that may be used with the connector panel of FIG. 7.

FIG. 10 illustrates, in plan view, an exemplary embodiment of a grounding strip 720 that may be used with the connector panel 116. It is to be appreciated that the invention is not limited to the example illustrated in FIG. 10, and the grounding strip 720 may have any structure suitable for use with a selected connector. For example, the grounding strip 300 of FIG. 3 or the grounding strip 600 of FIG. 6 may be modified to be used with the connector panel 116. Referring to FIG. 10, the grounding strip 720 includes a base portion 722, and a plurality of body portions 724 extending away from the base portion 722. The number of body portions 724 may correspond to the number of connector jacks 700 in connector panel 116. FIG. 10 also illustrates the contact portions 710 that contact the spring signal contacts of the connector jack 700, and the tabs 712 that may be used to secure the body portion 724 and contact portions 710 within the connector housing (see FIGS. 8, 9*a* and 9*b*).

Figure 11:
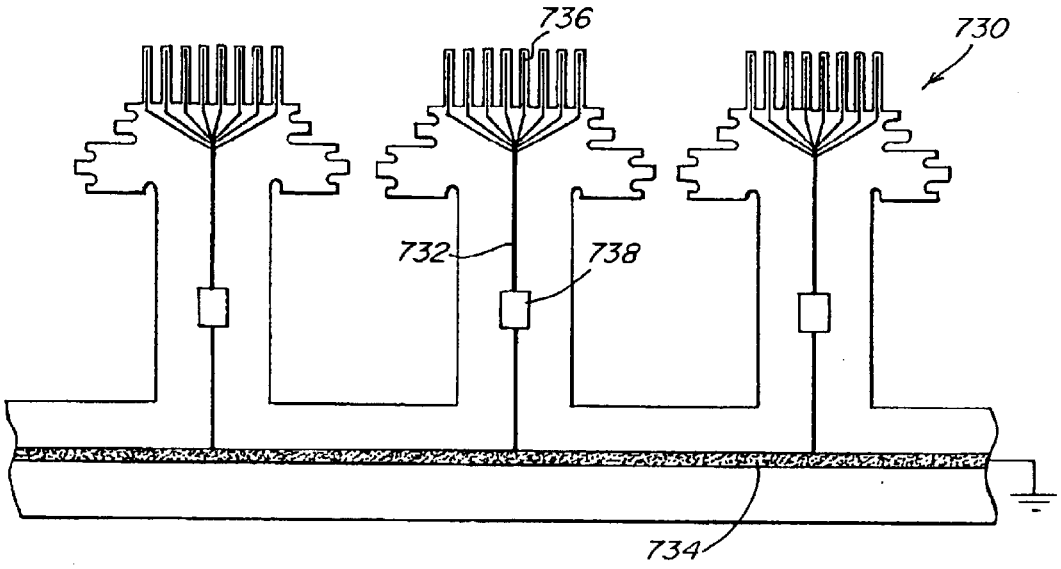
FIG. 11 is a plan view of another exemplary embodiment of a grounding strip that may be used with the connector panel of FIG. 7.

It is to be appreciated that, similar to grounding strip 300, the grounding strip 720 may be metal or may be a conductive plastic, or may be formed of any other suitable material. In one example, shown in FIG. 11, another example of a grounding strip 730 may include a dielectric with electrical circuitry 732 disposed thereon to provide a grounding connection 734 for the signal contacts portions 736. Furthermore, as described above, the circuitry may include series resistance or inductance 738 to provide a load between the signal contacts of the connector jack and the ground terminal 734, through which the static charge may be dissipated. In another example, the spring contacts of the connector jacks 700 may be provided with discharge protectors, such as zener diodes, to further protect against static discharge. These discharge protectors may be provided as elements within the connector housing (not shown) or may be included as part of the electrical circuitry on the grounding strip 730, as was illustrated for grounding strip 600 in FIG. 6.

Figure 12:
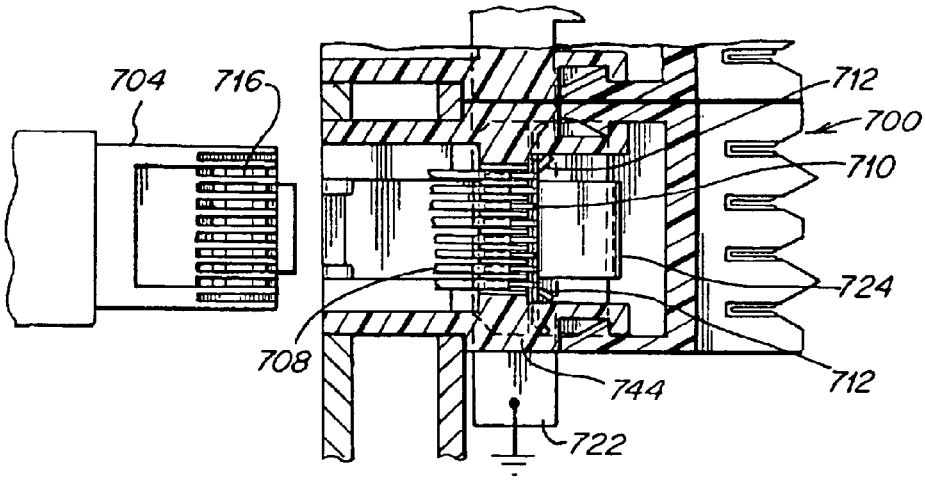
FIG. 12 is an exploded cross-sectional plan view of a connector jack and plug taken along lines 12—12 of FIG. 8.

FIG. 12 illustrates a cross-sectional view taken along lines 12—12 of FIG. 8 of the connector jack and plug of FIG. 8 with the grounding strip 720 installed. It can be seen that the base portion 722 of the grounding strip 700 fits along the rear of the connector panel 116 while the body portions 724 of the grounding strip 720 are folded over a section of the connector housing such that contact portions 710 of the grounding strip fit inside a comb portion of the connector housing, in contact with the spring signal contacts of the connector jack 700.

Figure 13:
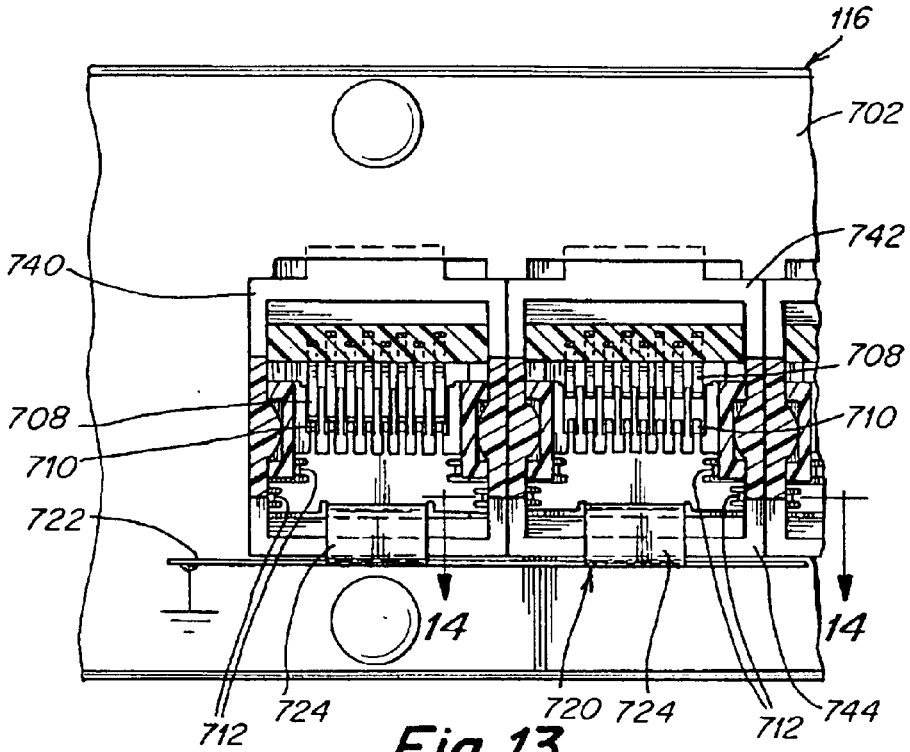
FIG. 13 is cross-sectional rear view of the connector panel of FIG. 7 taken along lines 13—13 of FIG. 8.

Referring to FIG. 13, there is illustrated a cross-sectional rear view of a portion of the connector panel 116, showing two connector jacks 740 and 742. Connector jack 740 does not have a connector plug mated with it, for example, corresponding to connector jack 740 of FIG. 7, and the spring signal contacts 708 are thus in contact with the contact portions 710 of the grounding strip 720. Connector jack 742, for example, corresponding to connector jack 742 of FIG. 7, has a connector plug 704 mated with it. As illustrated in FIG. 9*b*, the spring signal contacts 708 of the connector jack 742 have been moved into a position no longer in contact with the grounding portions 710 of the grounding strip 720.

Figure 15:
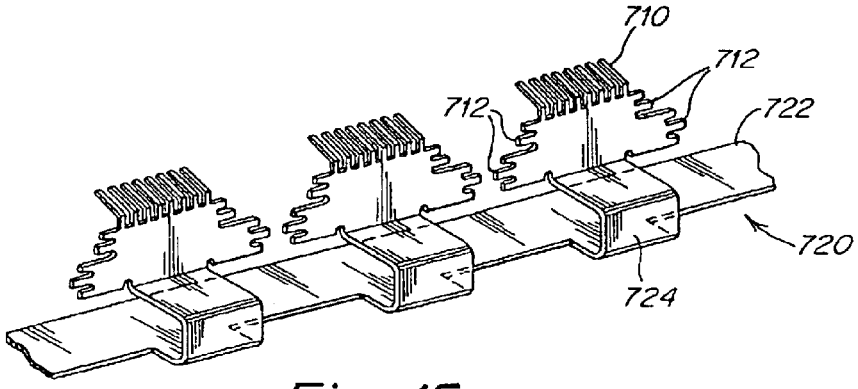
FIG. 15 is a perspective view of a partially formed grounding strip of FIG. 10.
Figure 14:
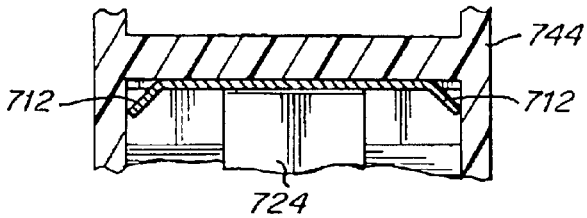
FIG. 14 is an enlarged fragmentary cross-sectional view of the connector panel taken along lines 14—14 of FIG. 13.

Referring to FIG. 14, it can also been seen that the tabs 712 of the grounding strip 720 are deformed against the sides of the connector housing 744, when the grounding strip is installed within the connector housing (as shown in FIG. 13), thereby retaining the body portions 724 and contact portions 710 of the grounding strip 700 in position within the housing 744 of the connector jacks 700. FIG. 15 illustrates the grounding strip 720 folded and arranged as it appears within the connector panel 116.

As described previously, the grounding strip 720 may have a selected number of body portions 722 corresponding to the number of connector jacks 700 installed within the connector panel 116. However, in another embodiment, the grounding strip 720 may be manufactured with a predetermined number of body portions 722, and two or more grounding strips 720 may be daisy-chained together to accommodate connector panels 116 having more connector jacks 700 that the predetermined number of body portions 722 of a single grounding strip 720. In one example, the daisy-chaining may be accomplished by overlapping part of the base portions 722 of two grounding strips 720 and securing them together, for example, by way of a screw or conductive adhesive, or by pressing them together inside a part of the connector or panel housing. In another example, the base portions 722 may be provided with features, for example, a slot and tab, to allow two or more grounding strips to be daisy-chained together. It is to be appreciated that this feature of daisy-chaining two or more grounding strips together may also be applied to the grounding strips 730, 600 and 300 of FIGS. 11, 6 and 3 respectively.

Having thus described various illustrative, non-limiting embodiments and aspects thereof, modifications and alterations will be apparent to those of skill in the art. Such modifications and alterations are intended to be included in this disclosure, which is for the purpose of illustration and explanation and not intended to define the limits of the invention. The scope of the invention should be determined from proper construction of the appended claims, and their equivalents.

What is claimed is:

1. An electrical jack comprising:

a housing having an opening defined therein through which a mating plug is received;

a grounding strip including a zener diode coupled thereto; and at least one elastically deformable signal contact residing within the housing disposed such that, when in a first position, the at least one elastically deformable signal contact is in contact with the grounding strip;

wherein the grounding strip is adapted to controllably ground any electrostatic discharges present in the at least one elastically deformable signal contact through the zener diode;

wherein as the mating plug is received any electrostatic discharges present in the mating plug are controllably grounded through the zener diode by the at least one elastically deformable signal contact being in a the first position in contact with the grounding strip, and wherein as the mating plug is further received, the elastically deformable signal contact moves to a second position not in contact with the grounding strip.

2. The electrical jack as claimed in claim 1, wherein the grounding strip comprises a metal strip.

3. The electrical jack as claimed in claim 1, wherein the grounding strip comprises a dielectric strip including the zener diode disposed thereon.

4. The electrical jack as claimed in claim 1, wherein the grounding strip comprises a conductive plastic.

5. An electrical connector panel comprising:

a housing having a comb portion;

a plurality of connector jacks disposed in the housing, each jack including a plurality of spring contacts located in the comb portion of the housing, the plurality of jacks being adapted to mate with a corresponding plurality of connector plugs; and a grounding strip coupled to a housing ground terminal and including a zener diode coupled to the grounding strip, the grounding strip comprising a first portion disposed in a rear of the panel, a body portion folded over a section of the housing and contact portions disposed inside the comb portion of the housing such that the plurality of spring contacts of each of the plurality of connector jacks are in contact with the contact portions of the grounding strip when in a first position;

wherein the plurality of spring contacts of one of the plurality of connector jacks move to a second position, not in contact with the grounding strip, when a connector plug is received by the connector jack; and wherein the grounding strip is adapted to prevent electrostatic buildup in the connector panel by controllably grounding, through the zener diode, any electrostatic charge present in any of the plurality of spring contacts of the connector jacks.

6. The electrical connector panel as claimed in claim 5, wherein the grounding strip comprises a metal strip.

7. The electrical connector panel as claimed in claim 5, wherein the grounding strip comprises a dielectric strip including the zener diode disposed thereon.

8. The electrical connector panel as claimed in claim 5, wherein the grounding strip comprises a conductive plastic.

9. The electrical connector panel as claimed in claim 5, wherein each of the plurality of connector jacks includes an opening adapted to receive the corresponding connector plug.

10. The electrical connector panel as claimed in claim 5, further including a resistor connected in series between the body portion of the grounding strip and the housing ground terminal.

11. The electrical connector panel as claimed in claim 5, wherein the grounding strip further comprises a plurality of tabs adapted to retain the contact portions of the grounding strip within the comb of the housing.

12. A cabling system comprising:

at least one electrical cable terminated in a connector plug;

a connector panel including at least one electrical jack adapted to receive and mate with the connector plug of the electrical cable, the electrical jack including a plurality of spring contacts movable between a first position and a second position;

a grounding strip including a zener diode disposed in the connector panel such that the plurality of spring contacts of the electrical jack are in contact with the grounding strip when in the first position, the grounding strip being coupled to a chassis ground terminal so as to provide controlled grounding, through the zener diode, of any electrostatic charges present in any of the plurality of spring contacts and the connector plug;

network equipment coupled to the connector panel; and terminal equipment coupled to the connector panel by the at least one electrical cable;

wherein the plurality of spring contacts of the electrical jack are moved into the second position when the connector plug is received by the electrical jack; and wherein the plurality of spring contacts are not in contact with the grounding strip when in the second position.

13. A method of discharging static in an unshielded twisted pair cable, the method including:

securing a grounding strip including a zener diode coupled to the grounding strip in a housing of an electrical jack having a plurality of movable signal contacts and an opening adapted to receive a mating connector plug, such that the movable signal contacts are in contact with the grounding strip when in a first position, thereby controllably grounding any electrostatic discharges to the unshielded twisted pair cable through the zener diode;

inserting the mating connector plug that terminates the unshielded twisted pair cable into the opening; and causing, by said inserting, the movable signal contacts to elastically deform to a second position not in contact with the grounding strip, thereby after controllably grounding any electrostatic charges present in the mating connector plug through the zener diode.

14. The electrical jack as claimed in claim 1, further comprising a resistor coupled to the zener diode.

15. The electrical connector panel as claimed in claim 5, further comprising a resistor coupled to the zener diode.

16. The cabling system as claimed in claim 12, further comprising a resistor coupled to the zener diode.

17. A cabling system comprising:

an unshielded cable including a plurality of transmission media;

an electrical jack that terminated the unshielded cable, the electrical jack having a plurality of movable signal contacts and an opening adapted to receive a mating connector plug; and a grounding strip including a zener diode coupled to the grounding strip, the grounding strip being positioned in the electrical jack such that the plurality of movable signal contacts are coupled to the grounding strip when in a first position so as to create an electrical circuit including the zener diode between the plurality of transmission media and a ground terminal, the electrical circuit being adapted to continuously discharge the plurality of transmission media.

18. The cabling system as claimed in claim 17, further comprising a resistor coupled to the zener diode.

19. The cabling system as claimed in claim 17, further comprising a piece of network equipment including a connector plug adapted to mate with the electrical jack;

wherein the plurality of movable signal contacts of the electrical jack are adapted to move to a second position not coupled to the grounding strip when the connector plug is substantially fully inserted into the electrical jack, thereby breaking the electrical circuit.

* * * * *